US005876196A

United States Patent [19]

Knöpfel et al.

[11] Patent Number: 5,876,196

[45] Date of Patent: Mar. 2, 1999

[54] BURNER FOR A HEAT GENERATOR

[75] Inventors: Hans Peter Knöpfel, Besenbüren; Thomas Ruck, Mellingen, both of Switzerland

[73] Assignee: ABB Research Ltd., Zurich, Switzerland

[21] Appl. No.: 760,410

[22] Filed: Dec. 4, 1996

[30] Foreign Application Priority Data

Dec. 21, 1995 [DE] Germany ..... 195 47 912.2

[51] Int. Cl.[6] ..... F23M 9/00

[52] U.S. Cl. ..... 431/183; 431/284; 431/351; 431/354

[58] Field of Search ..... 431/354, 351, 431/284, 183

[56] References Cited

U.S. PATENT DOCUMENTS 4,561,841 12/1985 Korenyi .
5,588,826 12/1996 Dobbeling et al. ..... 431/183

FOREIGN PATENT DOCUMENTS

0321809B1 6/1989 European Pat. Off. .
0436113A1 7/1991 European Pat. Off. .
0671590A1 9/1995 European Pat. Off. .
2415036 11/1974 Germany .
2538512 3/1976 Germany .
2845619C2 4/1979 Germany .
4408136A1 9/1995 Germany .
2175684 12/1986 United Kingdom .

*Primary Examiner*—Carroll B. Dority
*Attorney, Agent, or Firm*—Burns, Doane, Swecker & Mathis, L.L.P.

[57] ABSTRACT

In a burner for a heat generator, which consists essentially of a swirl generator (100*a*) for a combustion air stream (115) and of means for injecting a fuel into this combustion air stream, a mixing stage (220) is arranged downstream of said swirl generator. This mixing stage has, within a first stage part (200), a number of transition channels (201) running in the direction of flow, which ensure the continuous transfer of the flow (40), formed in the swirl generator (100*a*), into a tube (20) located downstream. A nozzle (103), arranged on the head side and on the burner axis (60), for the injection of a fuel is offset upstream at a distance relative to the start of the swirl generator.

20 Claims, 6 Drawing Sheets

103

100a
105
115
200
10
201
220
21
40
20
60

31
50
30

BURNER FOR A HEAT GENERATOR

BACKGROUND OF THE INVENTION

1. Field of the Invention

The present invention relates to a burner having a swirl generator.

2. Discussion of Background

A problem exists in the case of swirl-stabilized burners, as disclosed, for example, from U.S. Pat. No. 4,932,861 to Keller et al. as a premixing burner, if a liquid fuel is injected along the burner axis. The liquid column forming downstream of the fuel nozzle acts, particularly in the initial region downstream of the injection, in the same way as a solid body for the combustion air stream flowing tangentially into the interior of the premixing burner. In comparison with the flow without the injection of liquid fuel, the inflow of combustion air in the burner head is impeded, with the result that the tangential component of the swirl flow increases. This leads to a change in the flame position, which travels further upstream. If a further injection of a fuel is carried out along the tangential air inlet slits, then such fuel injection becomes extremely hazardous to operate, because a flame front acting in this region leads unavoidably to a flashback into the system. Furthermore, there is an enrichment of the flame center, which impairs the operation of such a premixing burner in many ways. In such operation, various disadvantages may arise, and these can be listed below, albeit not conclusively:

a) There is an increase, which cannot be underestimated, in the risk of a flashback, and this may easily lead to a burnup of parts of the premixing burner. If this occurs, there is a potential risk, inasmuch as parts which crumble away may cause serious damage to the machine;

b) Operation in an optimum flame position with a liquid fuel should not be designed to be over a wide range for safety reasons, and therefore the premixing burner has a small operating range;

c) The absence of integral intermixing from the outset between the spray cone and the combustion air stream leads unavoidably to an increase in the NOx emissions for the reasons mentioned above;

d) Furthermore, the inhomogeneous mixture distribution leads to further disadvantages which cause increased pollutant emissions and the generation of pulsations;

e) There are pronounced deviations from the optimum flow conditions for reliable and efficient combustion.

SUMMARY OF THE INVENTION

The invention intends to remedy this. The invention, as defined in the claims, is based on the object, in a premixing burner of the type initially mentioned, of achieving flame stabilization along with maximized efficiency and a minimization of pollutant emissions.

The essential measure of the invention relates to the provision of the head-side fuel nozzle which is set back upstream at a definite distance relative to the inflow of the combustion air, this distance depending on the selected spray angle. As a result of this offset, the mouth of the fuel nozzle comes to rest in the region of a fixed casing, with the result that it is possible, at the same time, to provide here, radially around the nozzle mouth, orifices through which purge air flows into the cross section induced by the fuel nozzle. The throughflow cross section of these orifices is selected in such a way that, in gas operation, the mass air flow flowing through these orifices is not sufficient to displace the recirculation zone further downstream. In liquid fuel operation, the fuel spray acts virtually as a jet pump, as a result of which the mass air flow through said orifices increases. This generates a relatively high axial momentum which diplaces the recirculation zone further downstream.

A further advantage of the invention is that, as a result of the setback of the fuel nozzle, the fuel spray penetrates with a larger cone radius into the main flow, that is to say into the combustion air flowing through the tangential air inlet slits. The fuel spray has already decomposed from a film into drops at this level and the lateral cone surface of this fuel spray has increased by a factor of 3 on entry into the region of the combustion air coming out of the tangential air inlet slits. As a result, the propagation of the fuel spray is improved and the inflow of combustion air is not impeded.

Finally, it should be pointed out that the mass air flow sucked in through the orifices in the region of the fuel nozzle prevents a wetting of the inner apex of the cone, since it is formed as a film between the fuel spray and the wall and, above all, defines the opening angle of the spray. Said angle remains constant over a wide load range.

A further essential advantage of the invention is to be seen in that the recirculation zone, and therefore the flame position, can be influenced directly during operation by varying the orifice cross sections for the mass air flow in the region of the fuel nozzle.

Advantageous and expedient developments for achieving the object according to the invention are defined in the further claims.

Exemplary embodiments of the invention are explained in more detail below with reference to the drawings. All elements not necessary for an immediate understanding of the invention have been omitted. Like elements are provided in the various figures with the same reference symbols. The direction of flow of the media is indicated by arrows.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figures 1, 8:
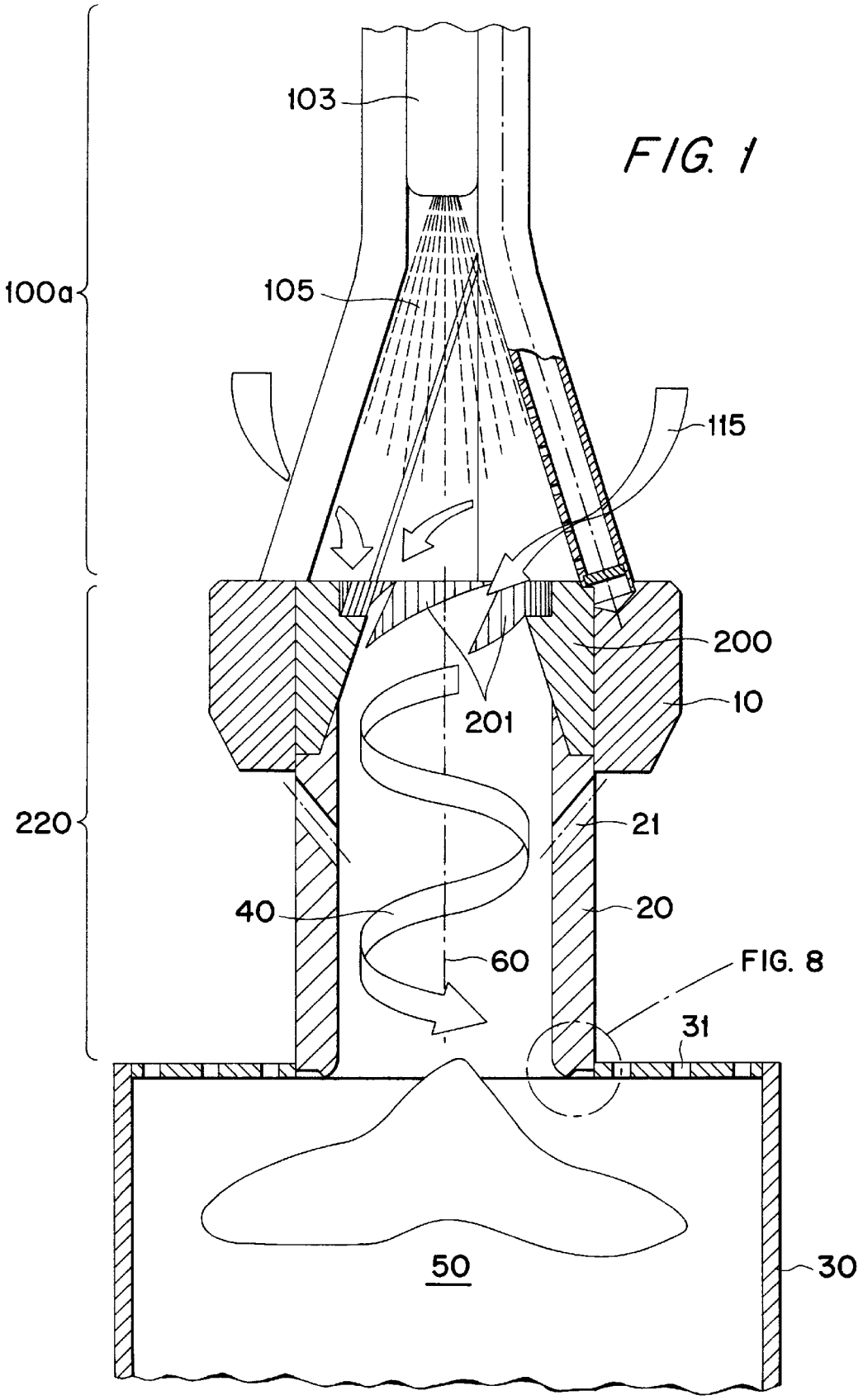
FIG. 1 shows a burner designed as a premixing burner and having a mixing stage downstream of a swirl generator.
FIG. 8 shows a separation edge for the spatial stabilization of the recirculation zone.

Referring now to the drawings, wherein like reference numerals designate identical or corresponding parts throughout the several views, FIG. 1 shows the overall design of a burner. Initially, a swirl generator 100*a* takes effect, its design being shown and described in more detail in the subsequent FIGS. 2 to 5. This swirl generator 100*a* is a conical structure which is subjected tangentially at a number of locations to a combustion air stream 115 flowing in tangentially. The flow forming therein is transferred continuously, by means of transition geometry provided downstream of the swirl generator 100*a,* into a transition piece 200, in such a way that no separation zones can occur there. The configuration of this transition geometry is described in more detail with reference to FIG. 6. This transition piece 200 is lengthened by a tube 20 on the outflow side of the transition geometry, the two parts forming the actual mixing tube 20, also known as mixing stage, of the burner. Of course, the mixing tube 220 can consist of a single piece, that is to say, in that case, the transition piece 200 and tube 220 are fused together to form a single coherent structure, the characteristics of each part being maintained. If the transition piece 200 and tube 20 are produced from two parts, these are connected by means of a bush ring 10, the same bush ring 10 serving on the head side as an anchoring surface for the swirl generator 100*a*. Furthermore, the advantage of such a bush ring 10 is that different mixing tubes can be used. Located on the outflow side of the tube 20 is the actual combustion chamber 30, which is symbolized here merely by the flame tube. The mixing tube 220 satisfies the condition that a specific mixing stage, in which perfect premixing of fuels of various kinds is achieved, is provided downstream of the swirl generator 100*a*. Furthermore, this mixing stage, that is to say the mixing tube 220, allows loss-free flow routing, so that, even when there is an operative connection with the transition geometry, initially no recirculation zone can form, as a result of which the mixing quality of all types of fuel can be influenced over the length of the mixing tube 220. However, this mixing tube 220 also has another property, which is that, in the mixing tube 220 itself, the axial velocity profile has a pronounced maximum on the axis, so that it is not possible for the flame to flash back out of the combustion chamber. It is true, nevertheless, that, in such a configuration, this axial velocity decreases towards the wall. In order to prevent flashback in this region too, the mixing tube 220 is provided in the direction of flow and in the circumferential direction with a number of regularly or irregularly distributed bores 21 of highly varied cross sections and directions, through which a quantity of air flows into the interior of the mixing tube 220 and which induce an increase in velocity along the wall in the manner of the laying of a film. In another possibility for achieving the same effect, the throughflow cross section of the mixing tube 220 is narrowed on the outflow side of the transition channels 201, which form the transition geometry already mentioned, with the result that the entire velocity level within the mixing tube 220 is raised. In the figure, these bores 21 run at an acute angle relative to the burner axis 60. Furthermore, the outlet of the transition channels 201 corresponds to the narrowest throughflow cross section of the mixing tube 220. Said transition channels 201 therefore bridge the relevant difference in cross section, without thereby adversely influencing the flow which is formed. If the selected measure of routing the tube flow 40 along the mixing tube 220 causes an unacceptable pressure loss, this can be remedied by providing a diffuser, not shown in the figure, at the end of the mixing tube. Alternatively, a Venturi can be provided at the end of the mixing tube to improve the flow characteristics. A combustion chamber 30 adjoins the end of the mixing tube 220, a jump in cross section occurring between the two throughflow cross sections only here does a central recirculation zone 50 having the properties of a flame holder form. If a flow boundary zone, in which eddy separations occur as a result of the vacuum prevailing there, forms within this jump in cross section during operation, this leads to an increased annular stabilization of the recirculation zone 50. The combustion chamber 30 has, on the end face, a number of orifices 31, through which a quantity of air flows directly into the jump in cross section and contributes there, inter alia, to reinforcing the annular stabilization of the recirculation zone 50. It should also be mentioned that the generation of a stable recirculation zone 50 also necessitates a sufficiently high swirl velocity in a tube. If this is initially undesirable, then stable recirculation zones may be generated by supplying small highly swirled air flows at the tube end, for example through tangential orifices. It is assumed here, in this case, that the quantity of air required for this purpose is approximately 5–20% of the total quantity of air. As regards the design of the separation edge at the end of the mixing tube 220, reference is made to the description relating to FIG. 8.

Figure 2:
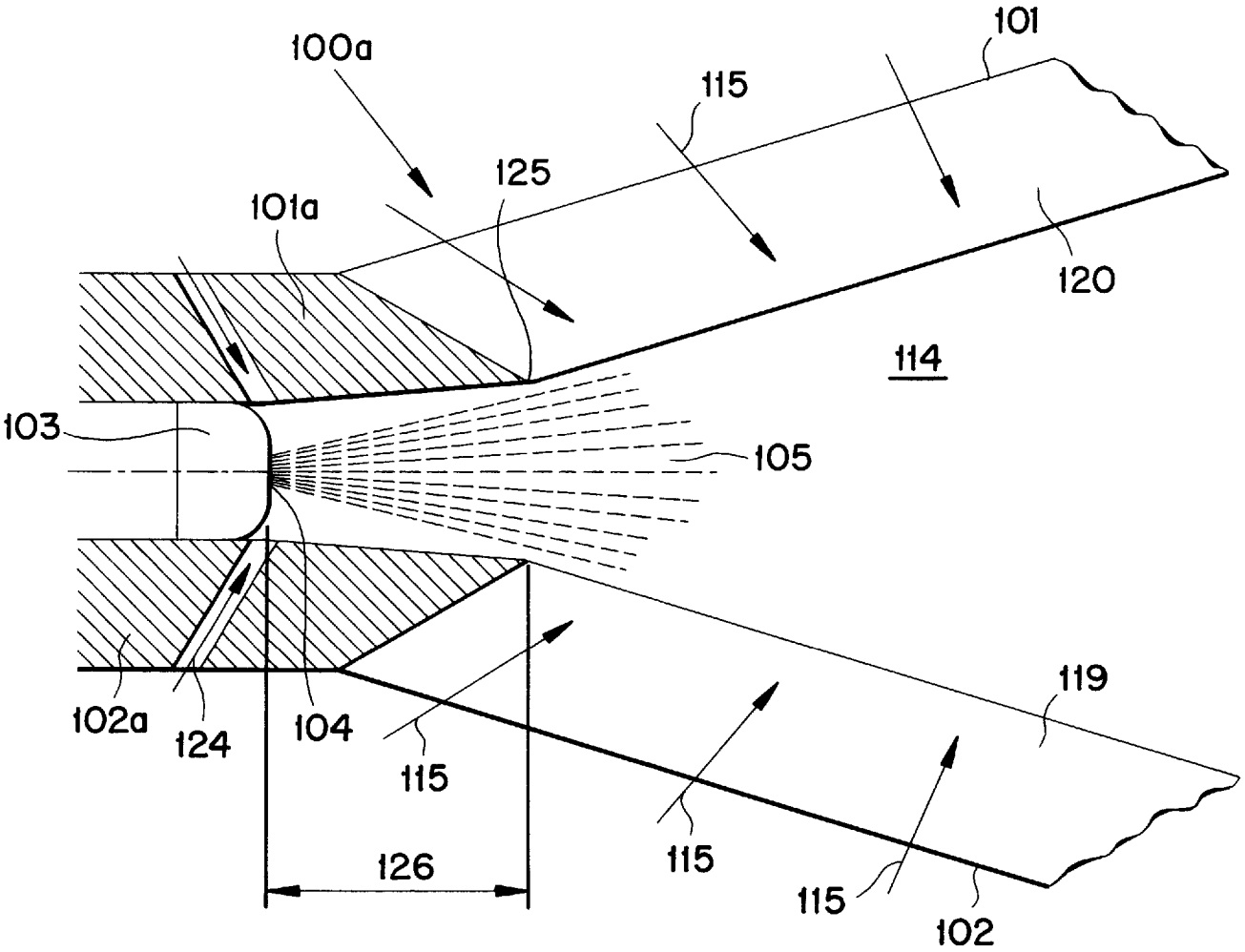
FIG. 2 shows a diagrammatic representation of the swirl generator with positioning of the fuel injection.

FIG. 2 shows a diagrammatic representation of a swirl generator 100*a,*which is described in more detail in the following FIGS. 3–5. Essential to FIG. 1 is the representation of the centrally placed fuel nozzle 103, which is set back upstream relative to the start 125 of the conical throughflow cross section, the distance 126 depending on the selected spray angle 105. As a result of this offset, the mouth 104 of the fuel nozzle 103 comes to rest in the region of the fixed casing 101*a,* 102*a* located on the head side. The fuel spray 105 occurring as a result of the fuel nozzle 103 penetrates with a relatively large cone radius into the region covered by the main flow of combustion air into the interior 114 of the burner, so that, in this region, the fuel spray 105 no longer behaves as a solid compact body, but has already decomposed into drops and is therefore easily penetrable. The inflow of combustion air 115 into the fuel spray 105 is no longer impeded, this having a positive effect on the mixing quality, in that the fuel spray 105 can be more easily penetrated by the combustion air. Furthermore, there are provided in the region level with the fuel spray mouth 104 radially or quasi-radially arranged orifices 124, through which purge air flows into the cross section induced by the size of the fuel nozzle 103. The throughflow cross section of these orifices 124 is selected in such a way that, in gas operation, the mass air flow flowing through these orifices is not sufficient to displace the backflow zone (see FIG. 1) further downstream. In liquid fuel operation, the fuel spray 105 acts virtually as a jet pump, as a result of which the mass air flow through said orifices 124 increases. This generates a relatively high axial momentum which displaces the recirculation zone further downstream, this acting as a good measure against a flashback of the flame. The conical part-bodies 101, 102 represented diagrammatically are dealt with in more detail in FIGS. 2–5. The configuration and mode of operation of the tangential air inlet slits 119, 120 are also treated in more detail there.

Figure 3:
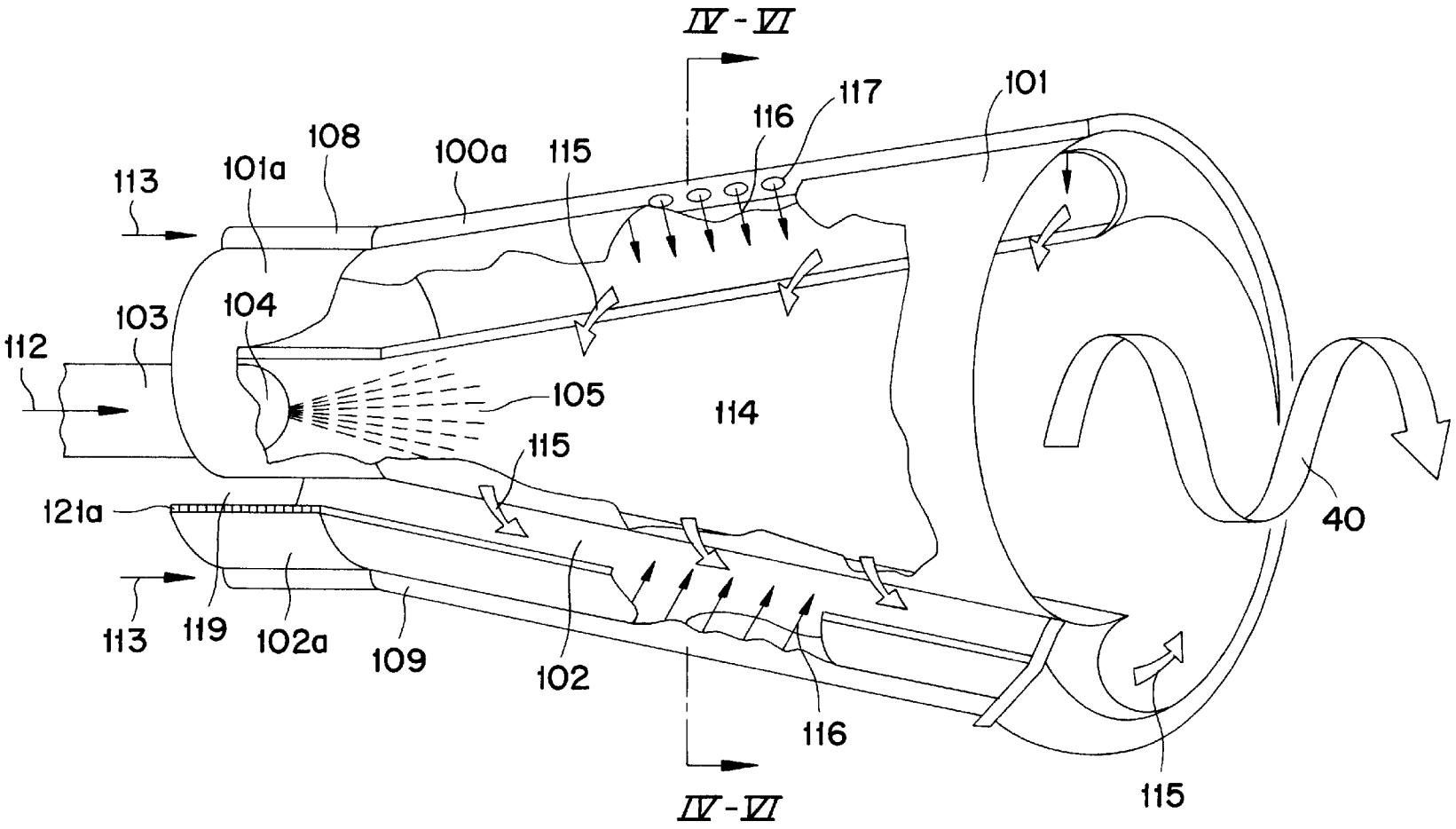
FIG. 3 shows a swirl generator as an integral part of the premixing burner according to FIG. 1, in a perspective representation, appropriately cut away.

To understand the design of the swirl generator 100*a* better, it is advantageous if at least FIG. 3 is referred to at the same time as FIG. 2. Furthermore, to avoid making FIG. 2 needlessly complicated, it merely suggests the guideplates 121*a,* 121*b* shown diagrammatically in FIG. 3. The description of FIG. 2 refers below, as required, to the figures mentioned.

The first part of the burner according to FIG. 1 forms the swirl generator 100*a* shown according to FIG. 2. This consists of two hollow conical part-bodies 101, 102 which are fitted one in the other in a laterally offset manner. Of course, the number of conical part-bodies may be greater than two, as shown in FIGS. 4 and 5; as explained in more detail further below, this depends, in each case, on the mode of operation of the burner as a whole. Providing a swirl generator consisting of a single spiral cannot be ruled out in the case of specific operating configurations. The offset of the respective mid-axis or longitudinal axes of symmetry 201*b,* 202*b* of the conical part-bodies 101, 102 relative to one another in each case provides in the adjacent wall, in a mirror-symmetrical arrangement, a tangential channel, that is to say an air inlet slit 119, 120 (FIG. 3), through which the combustion air 115 flows into the interior of the swirl generator 100*a,* that is to say into the conical cavity 114 of the latter. The conical shape of the illustrated part-bodies 101, 102 in the direction of flow has a specific fixed angle. Of course, depending on operational use, the part-bodies 101, 102 may have an increasing or decreasing cone taper in the direction of flow, in a similar way to a trumpet or tulip respectively. The two last-mentioned forms are not recorded in the drawing, since the average person skilled in the art can readily visualize them. The two conical part-bodies 101, 102 each have a cylindrical initial part 101*a,* 102*a,* said initial parts likewise being offset relative to one another in a similar way to the conical part-bodies 101, 102, so that the tangential air inlet slits 119, 120 are present over the entire length of the swirl generator 100*a.* A nozzle 103, preferably for a liquid fuel 112, is accommodated in the region of the cylindrical initial part, the injection 104 of which nozzle coincides approximately with the narrowest cross section of the conical cavity 114 formed by the conical part-bodies 101, 102. The injection capacity and the type of this nozzle 103 depend on the predetermined parameters of the relevant burner. Of course, the swirl generator 100*a* can be purely conical, that is to say designed without cylindrical initial parts 101*a,* 102*a.* Furthermore, the conical part-bodies 101, 102 each have a fuel line 108, 109, said fuel lines being arranged along the tangential air inlet slits 119, 120 and being provided with injection orifices 117, through which preferably a gaseous fuel 113 is injected into the combustion air 115 flowing through there, as the arrows 116 are i tended to symbolize. These fuel lines 108, 109 are preferably placed at the latest at the end of the tangential inflow, before entry into the conical cavity 114, in order to obtain an optimum air/fuel mixture. The fuel 112 delivered through the nozzle 103 is normally a liquid fuel, as mentioned, mixture formation with another medium being readily possible. This fuel 112 is injected into the conical cavity 114 at an acute angle. The nozzle 103 therefore produces a conical fuel spray 105 which is surrounded by the rotating combustion air 115 flowing in tangentially. In the axial direction, the concentration of injected fuel 112 is reduced continuously by means of the inflowing combustion air 115 in order to bring about mixing to evaporation. If a gaseous fuel 113 is introduced via the orifice nozzles 117, the formation of the fuel/air mixture takes place directly at the end of the air inlet slits 119, 120. If the combustion air 115 is additionally preheated or, for example, enriched with a recycled flue gas or waste gas, this assists the evaporation of the liquid fuel 112 in a sustained manner, before this mixture flows into the downstream stage. The same considerations also apply if liquid fuels are to be supplied via the lines 108, 109. It is necessary per se to impose narrow limits on the design of the conical part-bodies 101, 102 with regard to the cone angle and the width of the tangential air inlet slits 119, 120, so that the desired flow field of the combustion air 115 at the outlet of the swirl generator 100*a* can be established. It may be said in general terms that a reduction in size of the tangential air inlet slits 119, 120 is conducive to the more rapid formation of a recirculation zone as early as in the region of the swirl generator. The axial velocity within the swirl generator 100*a* can be varied by a corresponding supply (not shown) of an axial stream of combustion air. Appropriate swirl generation prevents the formation of flow operations within the mixing tube located downstream of the swirl generator 100*a.* Furthermore, the design of the swirl generator 100*a* is preeminently suitable for varying the size of the tangential air inlet slits 119, 120, as a result of which a relatively wide operating band width can be covered without changing the overall length of the swirl generator 100*a.* Of course, the part-bodies 101, 102 can also be displaced relative to one another in another plane, with the consequence that even an overlap of these may be provided. It is possible, furthermore, to fit the part-bodies 101, 102 one in the other spirally by rotating them in opposite directions. It is thus possible to vary, as desired, the shape, size and configuration of the tangential air inlet slits 119, 120, with the result that the swirl generator 100*a* can be used universally, without its overall length being changed.

Figure 4:
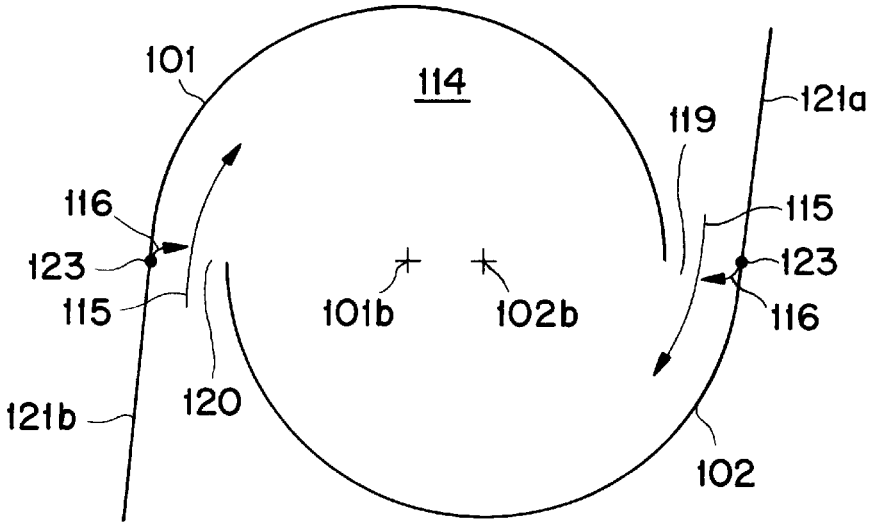
FIG. 4 shows a sectional plane through the swirl generator according to FIG. 3 having a two-shell design.

FIG. 4, then, shows the geometrical configuration of the guide plates 121*a,* 121*b.* They have a flow-introducing function, and, by their length, they lengthen the respective end of the conical part-bodies 101, 102 in the inflow direction in relation to the combustion air 115. The channeling of the combustion air 115 into the conical cavity 114 can be optimized by opening or closing the guide plates 121*a,* 121*b* about a center of rotation 123 placed in the region of the entry of this channel into the conical cavity 114, this being necessary, in particular, when the original gap size of the tangential air inlet slits 119, 120 is to be varied dynamically. Of course, these dynamic measures can also be provided in static form, if required guide plates form a fixed integral part with the conical part-bodies 101, 102. The swirl generator 100*a* can likewise also be operated without guide plates, or other aids may be provided for this purpose.

Figure 5:
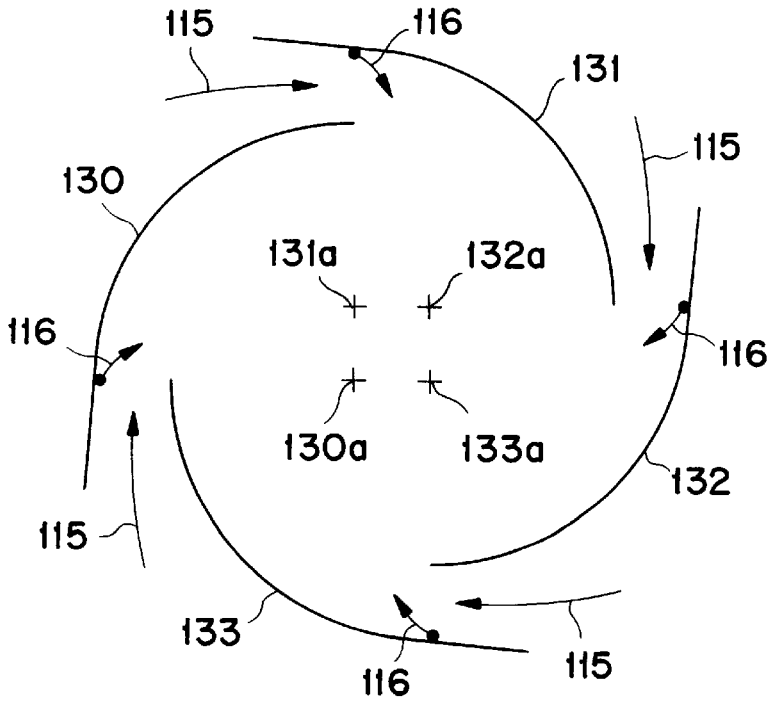
FIG. 5 shows a sectional plane through a four-shell swirl generator.

FIG. 5 shows, in contrast to FIG. 4, that the swirl generator 100*a* is now composed of four part-bodies 130, 131, 132, 133. Associated longitudinal axes of symmetry belonging to each part-body are designated by the letter a. It should be said, with regard to this configuration, that, on account of the lower swirl intensity generated thereby and in conjunction with a correspondingly enlarged slit width, it is the most suitable for preventing the eddy flow from breaking up on the outflow side of the swirl generator in the mixing tube, as a result of which the mixing tube can best perform the function assigned to it.

Figure 6:
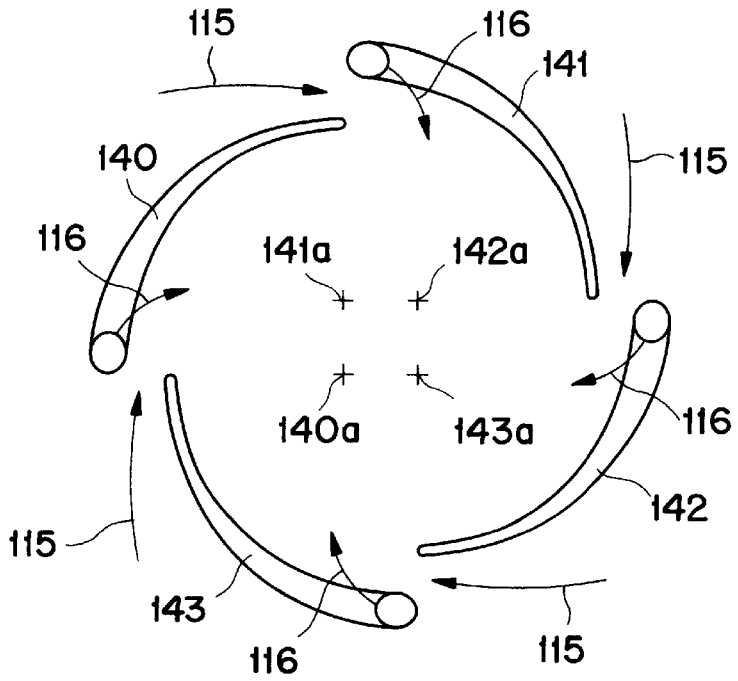
FIG. 6 shows a sectional plane through a swirl generator, the shells of which have blade-shaped profiling.

FIG. 6 differs from FIG. 5 in that, here, the part-bodies 140, 141, 142, 143 have a blade profile form which is provided for supplying a particular flow. Otherwise, the mode of operation of the swirl generator has remained the same. The admixing of the fuel 116 into the combustion air stream 115 takes place from inside the blade profiles, that is to say the fuel line 108 is now integrated into the individual blades. Here too, the longitudinal axes of symmetry belonging to the individual part-bodies are designated by the letter a.

Figure 7:
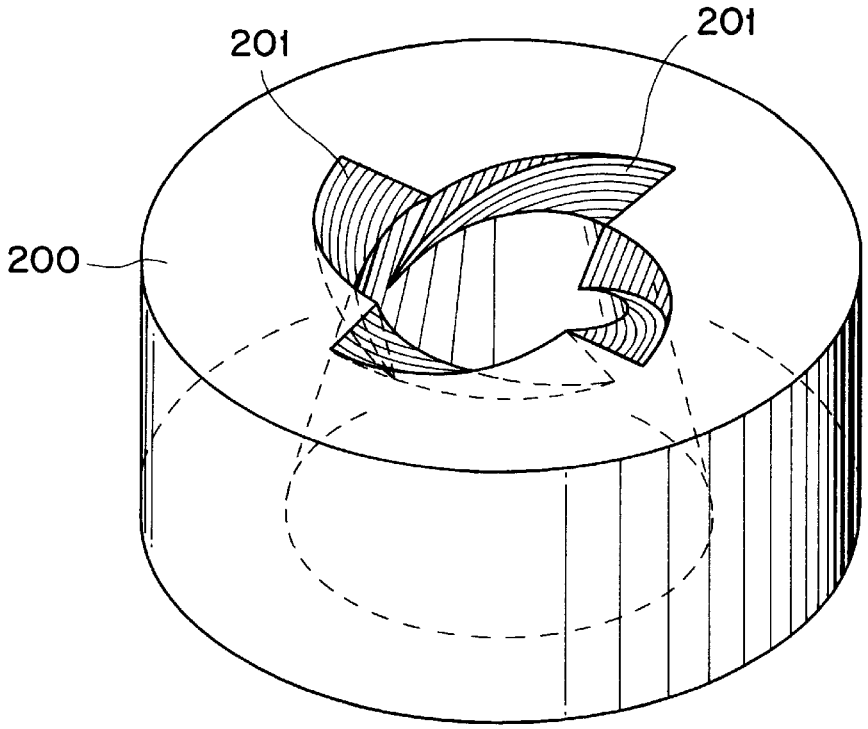
FIG. 7 shows a representation of the form of the transition geometry between the swirl generator and downstream mixing stage.
Figure 8:
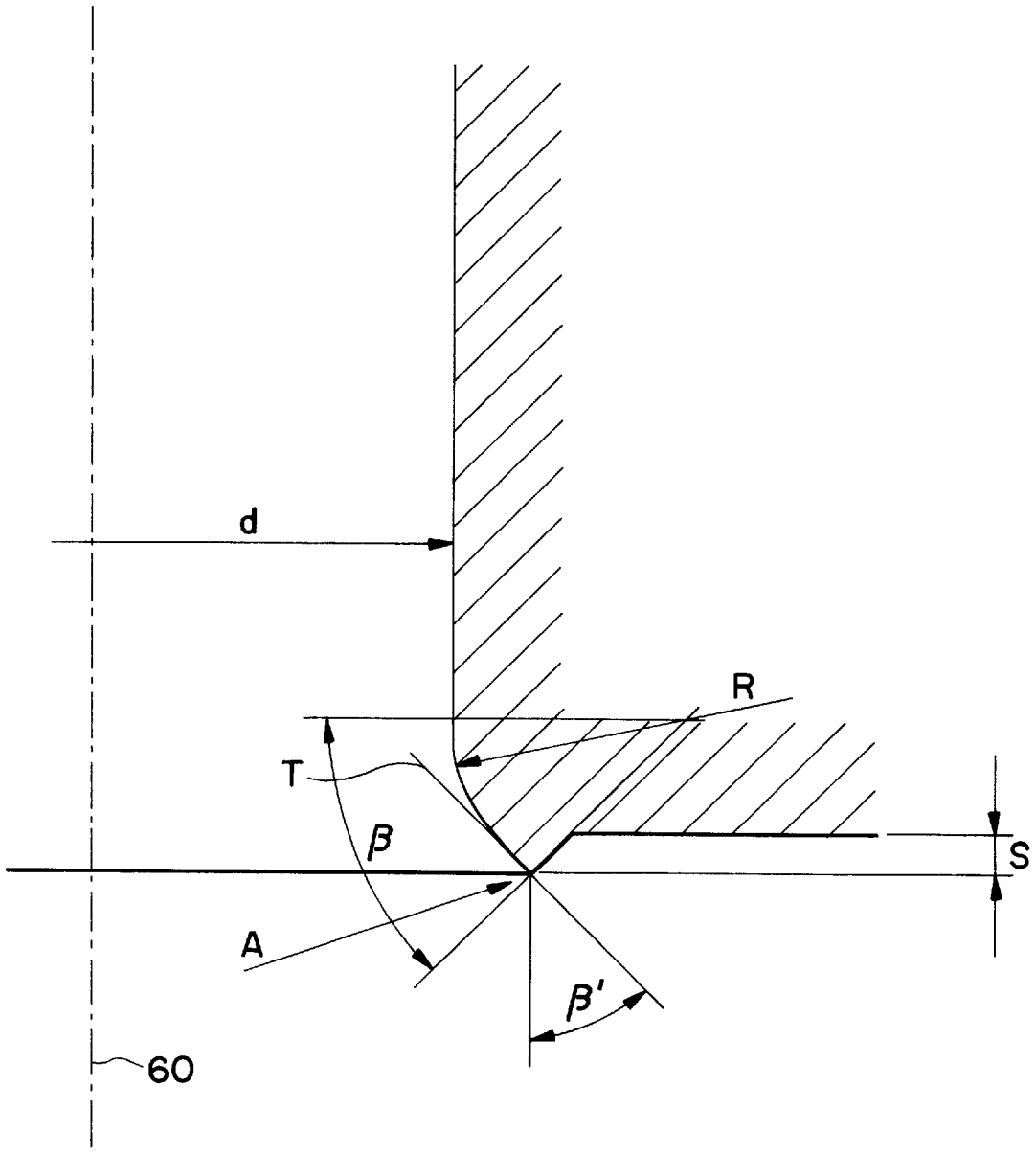

FIG. 7 shows the transition piece 200 in a three-dimensional view. The transition geometry is designed for a swirl generator 100*a* with four part-bodies, according to FIG. 4 or 5. The transition geometry therefore has, as a natural extension of the part-bodies acting upstream, four transition channels 201, with the result that the quarter cone surface of said part-bodies is lengthened until it intersects the wall of the tube 20 or mixing tube 220. The same considerations also apply if the swirl generator is designed by a principle other than that described with reference to FIG. 2. That surface of the individual transition channels 201 which runs downward in the direction of flow has a shape which runs spirally in the direction of flow and which follows a sickle-shaped course, in conformity with the fact that, in the present case, the throughflow cross section of the transition piece 200 widens conically in the direction of flow. The swirl angle of the transition channels 201 in the direction of flow is selected in such a way that subsequently, as far as the jump in cross section at the combustion chamber inlet, a sufficiently long distance still remains for the tube flow to ensure perfect premixing with the injected fuel. Furthermore, by virtue of the abovementioned measures, the axial velocity on the mixing tube wall downstream of the swirl generator increases. The transition geometry and the measures in the region of the mixing tube bring about a marked increase in the axial velocity profile towards the center point of the mixing tube, so that the risk of premature ignition is counteracted decisively.

FIG. 8 shows the already mentioned separation edge A which is formed at the burner outlet. The throughflow cross section of the tube 20 acquires, in this region, a transition radius R, the size of which basically depends on the flow within the tube 20. This radius R is selected in such a way that the flow comes to bear on the wall and thus permits the swirl velocity to rise sharply. Quantitatively, the size of the radius R can be defined by stating that it is >10% of the inside diameter d of the tube 20. In comparison with a flow without radius, the recirculation bubble 50 increases tremendously in size. This radius R runs as far as the outlet plane of the tube 20, the angle β between the start and end of the curvature being <90°. Along one leg of the angle β, the separation edge A runs into the interior of the tube 20 and thus forms a separation step S relative to the front point of the separation edge A, the depth of said step being >3 mm. Of course, the edge A, which here runs parallel to the outlet plane of the tube 20, can be brought level with the outlet plane again by means of a curved course. The angle β', which opens between the tangent of the separation edge A and the perpendicular to the outlet plane of the tube 20, is equal to the angle β. The advantages of this design have already been discussed in more detail above under the heading "Summary of the invention".

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A burner for preparing a fuel and air mixture for combustion in a heat generator, comprising:

a swirl generator defining an interior space for receiving a fuel and a combustion air flow and generating a swirl in the fuel and air flow, the swirl generator including at least two hollow conical part-bodies mounted adjacent one another in the other in a direction of flow to define a conical interior, wherein respective longitudinal axes of symmetry of these part-bodies are laterally offset relative to one another so that adjacent walls of the part-bodies form longitudinally extending inlet slots for the combustion air, the combustion air flow into the swirl generator being tangential relative to the conical interior of the swirl generator, a nozzle for injecting fuel into the swirl generator, the nozzle being disposed by a distance upstream of a cone entry, and a mixing conduit connected at an outlet of the swirl generator, the mixing conduit having transition channels, running in the direction of flow, for guiding the swirled flow into a tube downstream of the transition channels, wherein a fuel and air mixture is prepared for exit through an outlet of the mixing conduit.

2. The burner as claimed in claim 1, wherein a number of transition channels corresponds to a number of partial flows formed by the swirl generator.

3. The burner as claimed in claim 1, wherein an outlet plane of the tube is formed with a separation edge (A) for stabilizing and enlarging a recirculation zone which forms downstream of the outlet plane.

4. The burner as claimed in claim 3, wherein the separation edge (A) consists of a transition radius (R) formed in a region of the outlet plane of the tube and of a separation step (S) offset from the outlet plane.

5. The burner as claimed in claim 4, wherein the transition radius (R) is greater than 10% of an inside diameter of the tube, and wherein the separation step (S) has a depth greater than 3 mm.

6. The burner as claimed in claim 3, further comprising a conduit forming at least one of a diffuser and a Venturi stage arranged upstream of the separation edge (A).

7. The burner as claimed in claim 1, wherein the tube located downstream of the transition channels has a plurality of orifices arranged along the direction of flow and in the circumferential direction for injecting air into an interior of the tube.

8. The burner as claimed in claim 7, wherein the orifices are directed at an acute angle relative to a burner axis.

9. The burner as claimed in claim 1, wherein a flow cross section of the tube downstream of the transition channels is less than a cross section of the flow formed in the swirl generator.

10. The burner as claimed in claim 1, further comprising a combustion chamber arranged downstream of the mixing conduit, wherein, between the mixing conduit and the combustion chamber, there is a wall extending radially outward to form a jump in cross section to allow a recirculation zone to form in the combustion chamber in a region of this jump in cross section.

11. The burner as claimed in claim 1, wherein the fuel nozzle is arranged on a burner axis.

12. The burner as claimed in claim 1, wherein the fuel nozzle is operable with a liquid fuel and further comprising additional fuel nozzles operable with a gaseous fuel positioned to inject fuel into the inflow of combustion air.

13. The burner as claimed in claim 1, further comprising additional fuel nozzles arranged in a region of the inlet slots extending along the longitudinal extent.

14. The burner as claimed in claim 1, wherein the part-bodies each have a blade-shaped profiling in cross section.

15. The burner as claimed in claim 1, wherein the part-bodies have, in the direction of flow, one of a fixed cone angle, an increasing cone taper, and a decreasing cone taper.

16. The burner as claimed in claim 1, wherein the part-bodies are fitted one in the other spirally.

17. The burner as claimed in claim 1, wherein a throughflow cross section of the air inlet slots decreases in the longitudinal flow direction of the burner.

18. The burner as claimed in claim 1, wherein purge air orifices are provided in the swirl generator at an outlet plane of the fuel nozzle.

19. The burner as claimed in claim 1, wherein a throughflow cross section of the tube downstream of the transition channels is equal to a cross section of the flow formed in the swirl generator.

20. The burner as claimed in claim 1, wherein a throughflow cross section of the tube downstream of the transition channels is larger than a cross section of the flow formed in the swirl generator.

* * * * *